United States Patent [19]

Tarrson et al.

[11] 4,141,519

[45] Feb. 27, 1979

[54] THREAD STORAGE AND DISPENSING SYSTEM

[75] Inventors: Emanuel B. Tarrson, Chicago; Stevan Tisma, Niles, both of Ill.

[73] Assignee: John O. Butler Company, Chicago, Ill.

[21] Appl. No.: 833,441

[22] Filed: Sep. 15, 1977

[51] Int. Cl.[2] ..... B65H 49/18

[52] U.S. Cl. ..... 242/137.1; 225/47; 242/138

[58] Field of Search ..... 242/68.3, 129.5, 129.7, 242/129.8, 134, 136, 137, 137.1, 138, 139–141; 225/63, 46, 47

[56] References Cited

U.S. PATENT DOCUMENTS

| | | | |
|---|---|---|---|
| 2,944,761 | 7/1960 | Best | 242/139 |
| 3,502,281 | 3/1970 | McLain | 242/137.1 |
| 4,050,648 | 9/1977 | Tisma | 242/129.8 |

*Primary Examiner*—Leonard D. Christian
*Attorney, Agent, or Firm*—Laff, Whitesel & Rockman

[57] ABSTRACT

A spool of thread, such as dental floss, is housed in a holder, preferably made of plastic. The thread or floss is wound on a bobbin having a hollow, cylindrical hub area. A clutch for controlling the bobbin rotation comprises a split post having an enlarged cross section near the center thereof. The split post fits into the hollow, cylindrical hub area of the bobbin with the post squeezed slightly to provide a desired amount of friction between the central post and the cylindrical hub walls. The friction keeps the bobbin from unwinding; however, the friction is not so great that it keeps the thread or floss from pulling smoothly and evenly from the bobbin.

16 Claims, 7 Drawing Figures

THREAD STORAGE AND DISPENSING SYSTEM

This invention relates to holders for spools of thread and more particularly to clutch mechanisms for such holders, in order to prevent unwanted rotation or unwinding of the spool, while enabling a withdrawal of a predetermined amount of such thread responsive to a predetermined pulling force.

The term "thread" is used herein as a generic term to designate any suitable thread, string, twine, rope or the like. It is presently thought that dental floss is the specific thread that is most likely to be stored in the holder.

Thread holders of the inventive type have many uses, one of which is to hold a supply of dental floss which is very large relative to the volume enclosed by the outer contours of the holder. The desired general characteristics of such a holder usually requires an almost instantaneous removal of any selected length of thread, a means for cutting and holding the cut end of thread, and a means for securing the spool to prevent it from rotating or unwinding when the thread is not being removed therefrom. The "feel" of the thread being pulled from the holder should be one of a high-quality product.

In addition, when the thread is dental floss, the entire package should be as small as possible for the length of the enclosed thread so that it may be carried about in a pocket or purse, with a minimum of inconvenience. Beyond this, the holder should be attractive, to present a maximum sales appeal. It should also be of a shape and size which is easy for a person to manipulate, even when such person does not have normal dexterity.

Accordingly, an object of the invention is to provide a new and improved holder and packaging system for a spool of thread. Here an object is to provide a holder which can be made almost as small as the maximum-sized spool likely to be used in the holder. Further, an object is to give ready access to almost any desired length of the thread, while restraining the spool to prevent an unwanted unwinding.

Another object of the invention is to provide a basic design and form of thread holder which has general utility for virtually any size of spool or thread, and yet meets the specific needs of a dental floss holder. Here, an object is to provide a holder at a minimum cost.

A further object of the invention is to provide a dental floss holder having a high-quality "feel." Here an object is to provide a dental floss holder which does not become jammed or difficult to use if random unwinding should occur.

In keeping with an aspect of the invention, these and other objects are accomplished by means of a housing (usually plastic) constructed from at least one somewhat cylindrical section, which has a central post coaxially located therein. The thread or floss is wound on a bobbin having a hollow, generally cylindrical hub area molded therein. The clutch comprises a split central post having a generally enlarged cross section for receiving the hollow, cylindrical hub with a frictional gripping between the central post and the hub. The enlarged cross section is preferably distributed along the length of the post to keep the bobbin from tipping or binding. The friction keeps the bobbin from unwinding; however, the friction is not so great that it keeps the floss from pulling smoothly and evenly from the bobbin.

The nature of a preferred embodiment of the invention may be understood from the attached drawing, wherein.

Figure 1:
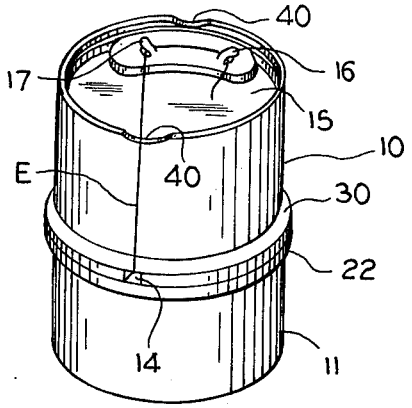
FIG. 1 is a perspective view of the inventive thread holder.

One embodiment of the inventive thread holder (FIG. 1) is especially adapted to store and dispense dental floss. The particular holder, which is shown here, comprises upper and lower holder shells or parts 10, 11, each of which has a generally cylindrical shape. A spool or ball 12 of thread (especially dental floss) is wound on a bobbin 13 for enclosure within the holder, with a loose end E of the thread leaving the holder through hole or opening 14. A top closure plate 15 closes the upper, cylindrical holder part 10 and has at least one semi-pierced detent 16 formed thereon for cutting and anchoring the loose end E of the thread. In this example, there are two such detents 16, 17 on closure plate 15.

The lower holder shell or part 11 comprises a generally cylindrical container having a closed bottom, to give a generally thimble shape.

An alternative embodiment for holding a lesser quantity of thread or floss would use only the lower, thimble-shaped, cylindrical section 11 integrally closed on one end and closed on the other end by a separate plate 15. The assignee of this invention usually makes the single unit, thimble-shaped section 11 with an octagonal, outside cross section, to provide a trademark container. When this single section housing is provided, closure plate 15 fits directly onto section 11, and there is no intervening, upper section 10.

In the two-section housing embodiment of FIG. 1, the rim or top of the lower shell part 11 flares outwardly (at 22) and extends cylindrically upwardly. Therefore, an enlarged circumferential space 22 is provided in the upper peripheral edge of lower part 11 for telescopingly receiving the bottom of the upper part 10. The outwardly flared cylindrical section 22 preferably includes a key or embossment 25 which fits into hole 14, for indexing the upper and lower parts 10, 11, when they are snapped together.

The upper part 10 comprises a generally cylindrical member having a diameter which is substantially the same as the diameter of the lower part 11. The lower edge of upper part 10 has a bead 30 which is approximately the same diameter as the flared cylindrical section 22 on the top of the lower part. Dependent below the bead 30 is a neck 31 of reduced diameter and a gripping portion 33 of slightly larger diameter. The gripping portion 33 is an annular bead surrounding the circumference of member 10.

The lower portion 11 has an internal, circumferential, outwardly projecting bead within the flared cylindrical area 22 which snaps over the gripping portion 33 of the upper part 10. The proportions are such that the dependent sections 31 and 33 slip with friction inside the cylindrical section 22 until bead 30 comes to rest on top of the part 22. When connected, the parts 10 and 11 resist separation, so that it is difficult to separate the holder without prying. To provide greater resistance to separation, parts 10 and 11 may be connected by sonic welding.

The upper interior surface of cylindrical part 10 contains a number of circumferentially-spaced embossments 34 for establishing an upper stop position. Thus, the closure plate 15 may be pressed into the top of upper part 10, to rest on the spaced embossments in a postion which is substantially perpendicular to the axis of the housing cylindrical sections.

At one or two points 40 in the upper rim of the part 10, there is a depression or cut-out which enables the loose end E of the thread to be brought under a semi-pierced detent 16, 17 and to be cut and anchored.

It should now be apparent that a bobbin of thread (especially dental floss) may be placed inside a holder having internal contours which are almost the same shape as, and only slightly larger than, the spool. Thus, there is virtually no wasted space or undue amount of bulk, either inside or outside the housing.

Inside one portion of the housing, here the lower part 11, there is a clutch assembly for preventing any unwanted or random unwinding of the thread on the bobbin 13. In greater detail, the lower cylindrical section has a centrally-located, bifurcated or split post 50 molded therein. This central, bifurcated or split post 50 projects upwardly into the region of the housing which receives the bobbin 13 of dental floss.

Figure 2:
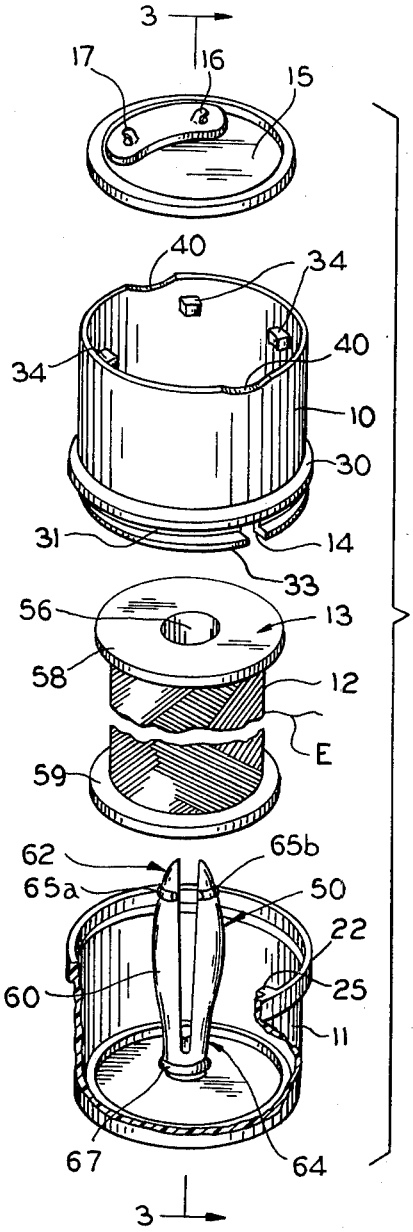
FIG. 2 is a perspective and exploded view of the holder of FIG. 1 and of the spool of thread enclosed therein.
Figure 3:
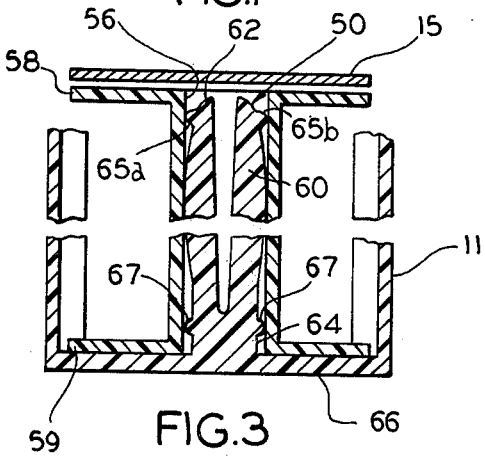
FIG. 3 is a cross-sectional view of the bobbin and split central post taken along line 3—3 of FIG. 2.
Figure 4:
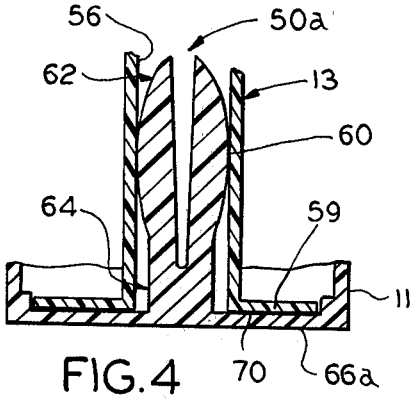
FIG. 4 is a similar cross-sectional view, also taken along line 3—3 of FIG. 2, and showing a modification to prevent the thread or floss from jamming the bobbin.
Figure 5:
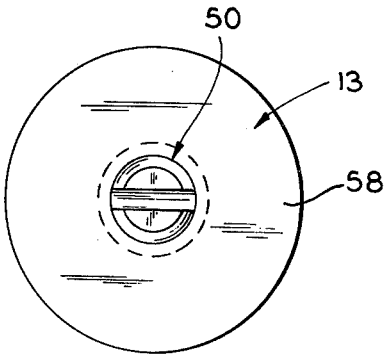
FIG. 5 is a plan view of the bobbin.

The dental floss is wound on bobbin 13 seen in perspective in FIG. 2, plan view in FIG. 5 and in cross section in FIGS. 3 and 4. The bobbin 13 comprises a generally hollow, cylindrical hub region 56 terminated at either end by flanges 58, 59.

In keeping with an aspect of the invention, the clutch action is provided by a combination of the split post 50 having an enlarged central area and the hollow, cylindrical hub area 56. The shape of the central post may vary with the embodiment that is used. Some embodiments also include means for preventing the bobbin from tipping and binding as the spool unwinds.

In greater detail, the central post 50 of the embodiments of FIGS. 2–4 has a generally enlarged or bulbous region 60, as compared to the smaller diameters at 62, 64. The overall diameter of the post 50 is approximately the same as the overall diameter of the cylindrical hub section 56. This means that the end sections 62, 64 are slightly smaller in diameter and the center section 60 is slightly larger in diameter, as compared to the diameter of the hub area 56.

Figure 7:
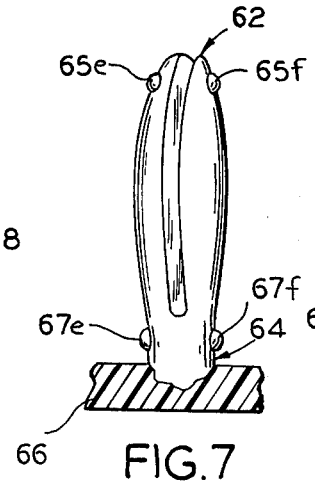
FIG. 7 is a perspective view (partly in cross section) showing yet another embodiment of the invention.

In the embodiment of FIG. 2, upper and lower circular or semi-circular beads 65, 67 are formed above and below the bulbous region 60. These beads do not add very much friction, but they bear against the internal walls of cylindrical hub areas 56 to keep the bobbin from tipping and binding, as the end E is pulled. In the embodiment of FIG. 7, two or more beads are shown as projections **65*c*,65*f*,67*c*,67*f* formed on the narrow parts 62, 64 of post 50, again to keep the bobbin from tipping. It is important that the beads 65*a*,65*b* or 65*e*, 65*f* on the upper or split end of the post should be diametrically opposed (i.e., they are equidistant from the floor 66 of the holder 11**). This way, the longitudinal forces which resist bobbin tipping are equal and opposite each other, with respect to tipping moments of the bobbin.

As a result of a generally rounded contour on upper end 62, the post 50 slips easily and with a predetermined amount of friction, into the hollow, cylindrical hub area 56. The amount of friction between the post 50 and bobbin 13 may be controlled with great precision since the mold for manufacturing the post and bobbin may be made with such precision.

Figure 6:
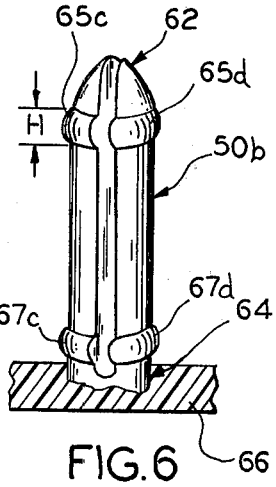
FIG. 6 is a perspective view (partly in cross section) showing a second embodiment of the split center post.

Two other embodiments of the split post 50 are shown in FIGS. 4 and 6. In FIG. 4, the central post **50*a* has a centrally located bulbous region 60; however, it does not have the upper and lower beads 65, 67. Instead, the lower bobbin flange 59 is recessed within means for restraining a radial displacement of the bobbin. In this example, the restraining means are a recessed region 70 of housing 11. As the bobbin turns, the flange 59 may ride on the circular wall of recess 70 to prevent bobbin tipping. In FIG. 6, the split post 50*b* has upper and lower circumferential beads 65*c*, 65*d* and 67*c*, 67*d*, each of which has a rubbing surface extending over a height H within the cylindrical hub region 56. This height H is adequate to establish a predetermined amount of friction between the bobbin and the post. Again, the circumferential beads 65*c*, 65*d* and 67*c*, 67*d* are shaped and located to provide equal and opposite forces with respect to tipping moments of the bobbin, thereby stabilizing rotation and resisting any tendency of the bobbin to tip. At least the upper contours of the beads are rounded to guide and direct the bobbin as it slips into the central hub recess 56**.

Means are provided for preventing the floss from becoming loose and thereafter jamming under the bobbin. In greater detail, the bobbin may be mounted, as shown in FIG. 3 with the flange 59 of bobbin 13 poised immediately above the internal side of floor 66 of housing section 11. As long as the floss does not come loose from the bobbin, this system functions very well. With the friction of the clutch created by the mechanical interference between post 50 and hub area 56, the floss should never become loose and jamming should never occur.

However, in some usages (especially where the housing 11, 12 is subjected to mechanical shock or vibration), the bobbin 13 may experience an unwanted rotation. The floss might then become slack and fall from the bobbin. As end E is pulled, the loose floss could move into the space between the flange 59 and the floor or bottom 66 of the housing 13, and begin accumulating there. The resulting snarl of floss feeds upon itself, as progressively more of the floss becomes jammed into the space under flange 59.

To forestall such a jammed bobbin, the floor or bottom of the housing 13 may be made in the form shown in FIG. 4. In greater detail, the housing floor or bottom **66*a* contains the recessed area 70 formed in substantially the shape and dimensions of the flange 59 on the bobbin 13**. That recess is just large enough to receive and support the bobbin with little or no added friction.

If there is a significant amount of added friction between flange and the recessed area wall, that amount is subtracted from the friction occurring at the center post. However, the recess is not large enough for the floss to easily pass into it, under any normally expected circumstances. Therefore, if for any reason the floss should loosen and even if a turn or two of the floss should fall from the bobbin and onto flange 59, it would not enter the recess 70 unless a turn of floss falls to a position which exactly fits over the crack between the flange and the side walls of the housing floor **66*a*. In the unlikely event that this should happen, the turn of floss would almost certainly remain above the bottom of such crack and would not be pulled into the horizontal (as viewed in FIG. 4) space between the lower side of flange 59 and the bottom 66***a*. When the end E is next pulled, the floss would come out of the crack and return to its normal condition above the housing bottom. The friction between the bobbin and the center post 50 would then restrain rotation and restore normal thread tension.

Hence, it is seen that a jammed condition caused by floss accumulation in the space between flange 59 and floor 66*a* will not occur under any conditions which are likely to happen. Even if the floss should somehow partially enter the recess, it is most unlikely to reach the space 70. Therefore, it is seen that the recess 70 performs the twin functions of stabilizing rotation to prevent the bobbin from tipping and of preventing the floss from becoming snarled between the bobbin and its holder.

Those who are skilled will readily perceive how changes and modifications may be made, without departing from the teachings of the invention. For example, the various principles may be combined so that the embodiment of FIG. 6 is used in combination with the recess 70 of FIG. 4, for example. Therefore, the appended claims are to be construed to cover all equivalents which fall within the true scope and spirit of the invention.

We claim:

1. A thread holder comprising at least one shell part including a split post coaxially located therein to enable a rotation of a bobbin means for supporting a coiled length of thread, said bobbin being mounted on said post for rotation when said thread is pulled, said bobbin means having a hollow, central cylindrical hub region with a cross section for receiving and embracing said split post, the cross sections of said post and hollow hub region being proportioned for contacting and dragging with predetermined friction against a rotation of said bobbin caused by pulling said thread, the friction being great enough to prevent an unwanted and random rotation of said bobbin for unwinding of thread from said bobbin and yet small enough to preclude any substantial opposition to rotation of said bobbin in order to withdraw a desired amount of thread.

2. The holder of claim 1 wherein said split post has an enlarged cross section at last partially distributed along the longitudinal length thereof, for gripping the internal walls of said hollow, cylindrical region.

3. The holder of claim 2 wherein said enlarged cross section includes a bulbous section near the longitudinal center of the post.

4. The holder of claim 3 and means associated with said bulbous section for preventing said bobbin from tipping on said post.

5. A thread holder comprising at least one shell part including a split post coaxially located therein to enable a rotation of a bobbin means mounted on said post, said bobbin means having a hollow, central cylindrical hub region with a cross section for receiving and embracing said split post, said split post having en enlarged cross section at least partially distributed along the longitudinal length thereof, for gripping the internal walls of said hollow, cylindrical region, said enlarged cross section includes a bulbous section near the longitudinal center of the post, the cross sections of said post and hollow hub region being proportioned for contacting and dragging with predetermined friction against a rotation of said bobbin, the friction being great enough to prevent an unwanted and random unwinding of thread from said bobbin and yet small enough to preclude any substantial opposition to a desired withdrawal of thread, means associated with said bulbous section for preventing said bobbin from tipping on said post, and means for preventing tipping comprising upper and lower beads formed above and below said bulbous section.

6. The holder of claim 4 wherein the means for preventing tipping comprises means formed in said holder for restraining a radial displacement of the periphery of said bobbin.

7. A thread holder comprising at least one shell part including a split post coaxially located therein to enable a rotation of a bobbin means mounted on said post, said bobbin means having a hollow, central cylindrical hub region with a cross section for receiving and embracing said split post, said split post has an enlarged cross section at least partially distributed along the longitudinal length thereof, for gripping the internal walls of said hollow, cylindrical region, said enlarged cross section includes a plurality of circumferential beads distributed along the length of said post, the cross sections of said post and hollow hub region being proportioned for contacting and dragging with predetermined friction against a rotation of said bobbin, the friction being great enough to prevent an unwanted and random unwinding of thread from said bobbin and yet small enough to preclude any substantial opposition to a desired withdrawal of thread.

8. The holder of claim 7 wherein said beads are formed to provide equal and opposite forces with respect to tipping moments of said bobbin.

9. The holder of claim 2 wherein there are two of said shell parts, each of said shell parts comprising a generally cylindrical member, one of said parts being integrally closed on one end to provide a generally thimble-shaped shell, means on said two shell parts for snapping together said two parts at their open ends, said split post extending away from said closed end of said one part and being coaxially located with respect to said two snapped-together shell parts.

10. The holder of claim 1 wherein said bobbin has at least one flange, one part being integrally closed on one end to form a generally thimble-shaped container, the floor or bottom of said thimble-shaped part having a recessed opening formed therein to receive with little play and conform to the contours of the rim of said one flange on said bobbin to stabilize the rotation of said bobbin and to prevent the thread on said bobbin from passing off said bobbin and becoming jammed in said recessed opening between said flange and said floor or bottom of said thimble-shaped part.

11. The holder of claim 10 wherein there is an enlarged cross section on said split post to provide a dragging friction upon said bobbin.

12. The holder of claim 1 wherein said split post and said central hub region are mutually shaped to confine said friction to a generally central longitudinal part of said hub region while resisting moments tending to tip said bobbin.

13. An article comprising a holder means enclosing a bobbin means for supporting a coiled thread within said holder, said bobbin having a hollow hub; a bifurcated post for receiving said hub and thereby supporting said bobbin means so that said bobbin means can rotate about said post when said thread is pulled from said bobbin, the bifurcations of said post extending longitudinally along at least part of the length thereof and running parallel to the axis of said hub; said bifurcated post fitting into, contacting, and dragging against the hollow of said hub with predetermined friction, said friction being great enough to prevent an unwanted and random rotation of said bobbin which would produce an unintentional unwinding of said thread and yet said friction being small enough to preclude any substantial opposition to a rotation of said bobbin in order to produce a desired withdrawal of any desired length of thread which may be wound upon said bobbin.

14. The article of claim 13 wherein post is integrally enclosed within and extends coaxially from one end of said holder.

15. The article of claim 13 wherein said post includes an enlarged section for gripping at least the longitudinal central part of said hollow hub.

16. The article of claim 13 and recess means for embracing one end of said bobbin to stabilize the rotation thereof and to prevent any thread which may be wound upon said bobbin from jamming under said bobbin.

* * * * *

UNITED STATES PATENT AND TRADEMARK OFFICE

CERTIFICATE OF CORRECTION

PATENT NO. : 4,141,519

DATED : February 27, 1979

INVENTOR(S) : Emanuel B. Tarrson; Stevan Tisma

It is certified that error appears in the above-identified patent and that said Letters Patent are hereby corrected as shown below:

Column 5, line 48, "last" should be --least--

Column 5, line 62, "en" should be --an--

Column 8, line 3, insert --said-- between "wherein" and "post"

Signed and Sealed this

*Fifth* Day of *June 1979*

[SEAL]

*Attest:*

RUTH C. MASON
*Attesting Officer*

DONALD W. BANNER
*Commissioner of Patents and Trademarks*